US005560693A

United States Patent [19]

Musser et al.

[11] Patent Number: 5,560,693

[45] Date of Patent: Oct. 1, 1996

[54] WALL MOUNTED FILING CABINET

[76] Inventors: Curtis D. Musser; Theodore C. Musser, both of 2581 Rhoads Ave., Columbus, Ohio 43207

[21] Appl. No.: 521,874

[22] Filed: Aug. 31, 1995

[51] Int. Cl.[6] ..... A47B 67/04; A47F 5/08

[52] U.S. Cl. ..... 312/245; 312/242; 312/107; 232/17; 232/24; 232/1 E

[58] Field of Search ..... 312/245, 242, 312/107, 198, 293.2, 321.5; 232/1 R, 1 E, 17, 20, 21, 24, 27, 38, 39, 45, 47; 220/558, 23.2, 23.6

[56] References Cited

U.S. PATENT DOCUMENTS

| | | | |
|---|---|---|---|
| 849,622 | 4/1907 | Kent | 232/1 R |
| 1,469,359 | 10/1923 | Craw | 232/1 E |
| 1,612,335 | 12/1926 | Wilhelm | 232/24 |
| 2,237,176 | 4/1941 | Dorman | 312/107 |
| 2,730,106 | 1/1956 | York | 312/242 X |
| 3,620,404 | 11/1971 | Grasso | 312/242 X |
| 4,231,626 | 11/1980 | Amtmann et al. | 312/245 X |
| 5,083,703 | 1/1992 | Blyakharov | 232/17 |
| 5,267,688 | 12/1993 | Benefield | 232/17 |

FOREIGN PATENT DOCUMENTS

| | | | |
|---|---|---|---|
| 2046083 | 11/1980 | United Kingdom | 312/245 |

*Primary Examiner*—Peter M. Cuomo
*Assistant Examiner*—Rodney B. White

[57] ABSTRACT

A wall mounted filing cabinet comprised of a cabinet having a plurality of openings formed through a front surface thereof. The cabinet is securable to a wall. The device contains a plurality of bins. The number of bins corresponds to the number of openings formed in the cabinet. Each of the bins is configured to be received within a corresponding opening. Each bin has a U-shaped handle secured to a front surface thereof.

1 Claim, 3 Drawing Sheets

WALL MOUNTED FILING CABINET

BACKGROUND OF THE INVENTION

1. Field of the Invention

The present invention relates to a wall mounted filing cabinet and more particularly pertains to providing a place to store office documents but not requiring floor space with a wall mounted filing cabinet.

2. Description of the Prior Art

The use of wall cabinets is known in the prior art. More specifically, wall cabinets heretofore devised and utilized for the purpose of mounting on a wall for storage of items are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,267,786 to Aisley discloses a medicine cabinet.

U.S. Pat. No. 4,076,350 to Crist discloses a universal recessed wall cabinet.

U.S. Pat. No. 3,751,131 to Denker et al. discloses a rectangular wall cabinet for recessed or surface mounting.

U.S. Pat. No. Des. 296,276 to Flaherty discloses the ornamental design for a medical storage cabinet.

U.S. Pat. No. Des. 287,800 to Lance discloses the ornamental design for a built-in wall cabinet.

U.S. Pat. No. Des. 285,887 to Palka discloses the ornamental design for a medicine cabinet.

While these devices fulfill their respective, particular objective and requirements, the aforementioned patents do not describe a wall mounted filing cabinet for providing a place to store office documents but not requiring floor space.

In this respect, the wall mounted filing cabinet according to the present invention substantially departs from the conventional concepts and designs of the prior art, and in doing so provides an apparatus primarily developed for the purpose of providing a place to store office documents but not requiring floor space.

Therefore, it can be appreciated that there exists a continuing need for new and improved wall mounted filing cabinet which can be used for providing a place to store office documents but not requiring floor space. In this regard, the present invention substantially fulfills this need.

SUMMARY OF THE INVENTION

In the view of the foregoing disadvantages inherent in the known types of wall cabinets now present in the prior art, the present invention provides an improved wall mounted filing cabinet. As such, the general purpose of the present invention, which will be described subsequently in greater detail, is to provide a new and improved wall mounted filing cabinet and method which has all the advantages of the prior art and none of the disadvantages.

To attain this, the present invention essentially comprises a cabinet having a generally rectangular configuration. The cabinet has a front surface, a rear surface, a top surface, a bottom surface, and two side surfaces. The front surface has a plurality of rectangular shaped openings formed therethrough. The rear surface has a plurality of securement brackets secured thereto. Each of the securement brackets has screws extending therethrough to secure the cabinet to a wall. The device contains a plurality of bins. The number of bins corresponds to the number of rectangular shaped openings formed in the cabinet. Each of the bins is configured to be received within a corresponding rectangular shaped opening. Each of the bins has an open top end, a closed bottom end, a front wall, a rear wall, and two side walls. A lower lip portion is secured to a lower edge of the front wall whereby the lower lip portion holds the bin against a lower edge of the corresponding rectangular shaped opening of the cabinet. An upper lip portion is secured to an upper edge of the rear wall whereby the upper lip portion contacts an interior upper edge of the cabinet when the bin is in an open configuration to prevent the bin from falling out of the corresponding opening. The front surface of each bin has a U-shaped handle secured thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wall mounted filing cabinet which has all the advantages of the prior art wall cabinets and none of the disadvantages.

It is another object of the present invention to provide a new and improved wall mounted filing cabinet which may be easily and efficiently manufactured and marketed.

It is a further object of the present invention to provide a new and improved wall mounted filing cabinet which is of durable and reliable construction.

An even further object of the present invention is to provide a new and improved wall mounted filing cabinet which is susceptible of a low cost of manufacture with regard to both materials and labor, and which accordingly is then susceptible of low prices of sale to the consuming public, thereby making such a wall mounted filing cabinet economically available to the buying public.

Still yet another object of the present invention is to provide a new and improved wall mounted filing cabinet which provides in the apparatuses and methods of the prior art some of the advantages thereof, while simultaneously overcoming some of the disadvantages normally associated therewith.

Even still another object of the present invention is to provide a new and improved wall mounted filing cabinet for providing a place to store office documents but not requiring floor space.

Lastly, it is an object of the present invention to provide a new and improved wall mounted filing cabinet comprised of a cabinet having a plurality of openings formed through a front surface thereof. The cabinet is securable to a wall. The device contains a plurality of bins. The number of bins corresponds to the number of openings formed in the cabinet. Each of the bins is configured to be received within a corresponding opening. Each bin has a U-shaped handle secured to a front surface thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
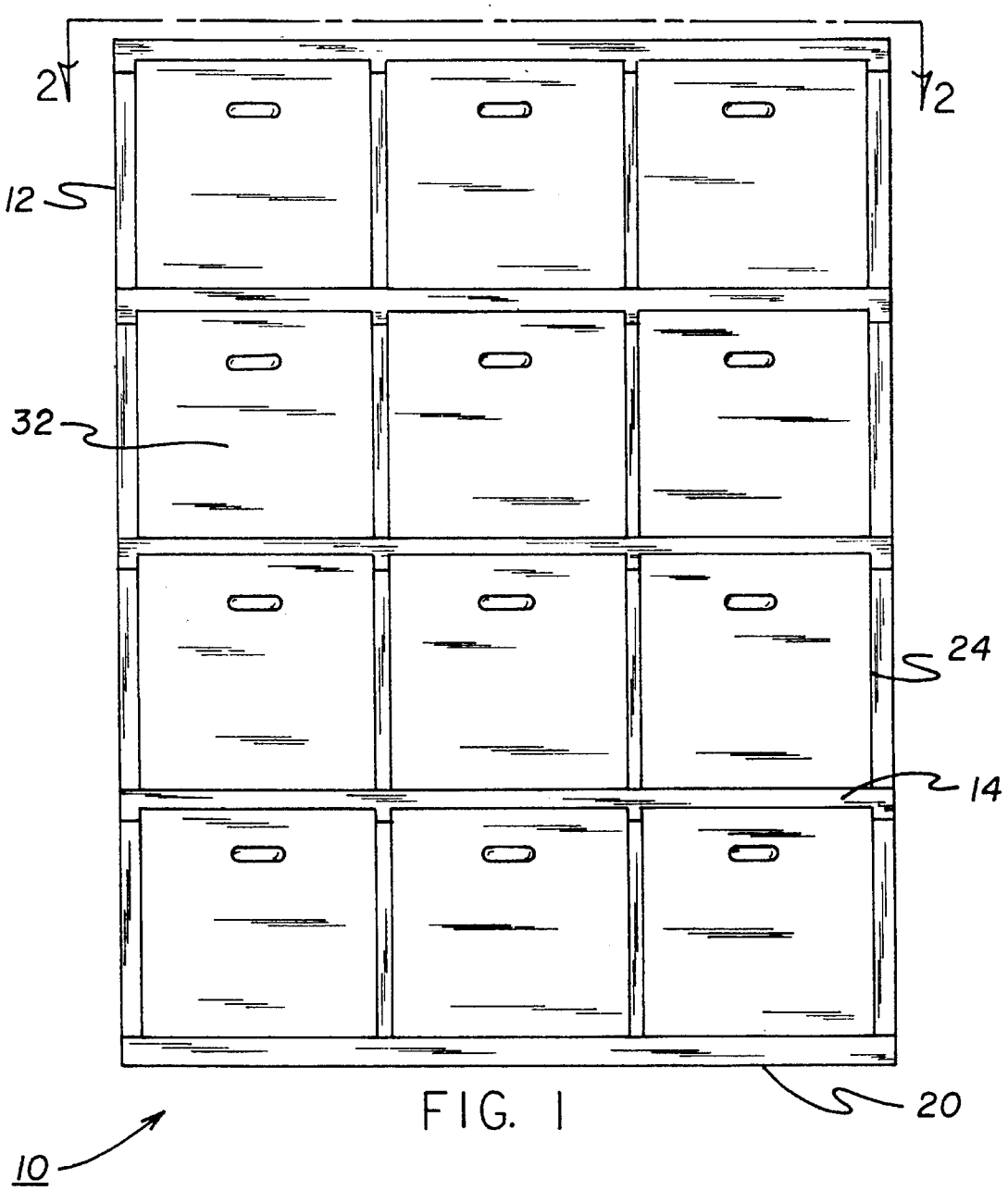
FIG. 1 is a front view of the preferred embodiment of the wall mounted filing cabinet constructed in accordance with the principles of the present invention.
Figure 2:
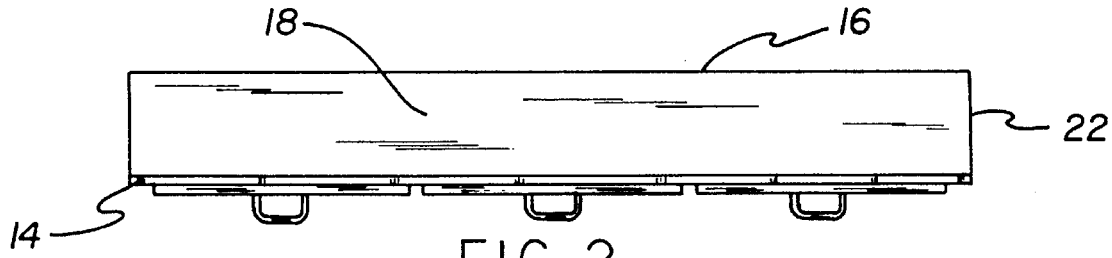
FIG. 2 is a cross-sectional view as taken along line 2—2 of FIG. 1.
Figure 3:
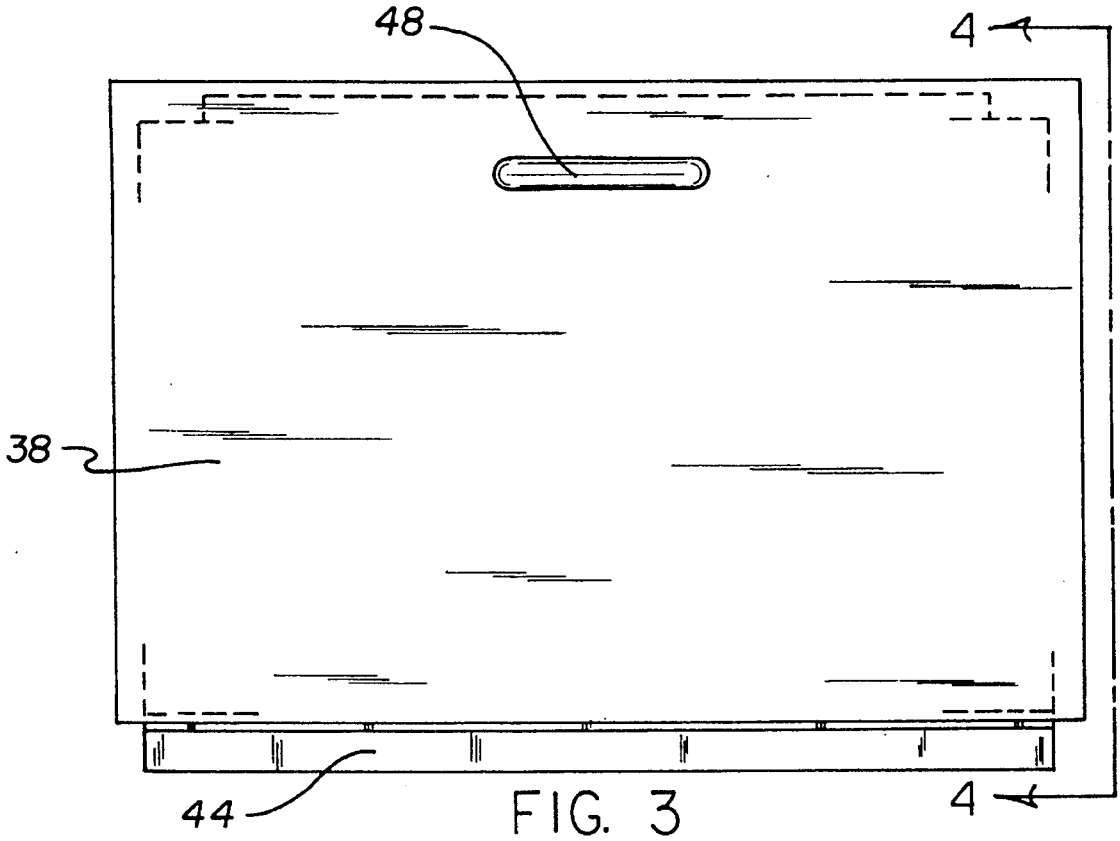
FIG. 3 is a front view of the bin of the present invention.
Figure 4:
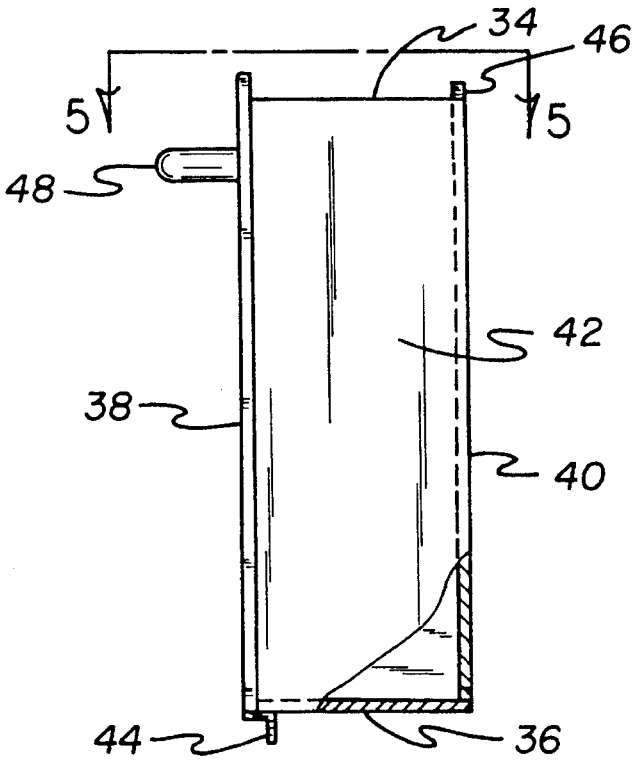
FIG. 4 is a cross-sectional view as taken along line 4—4 of FIG. 3.
Figure 5:
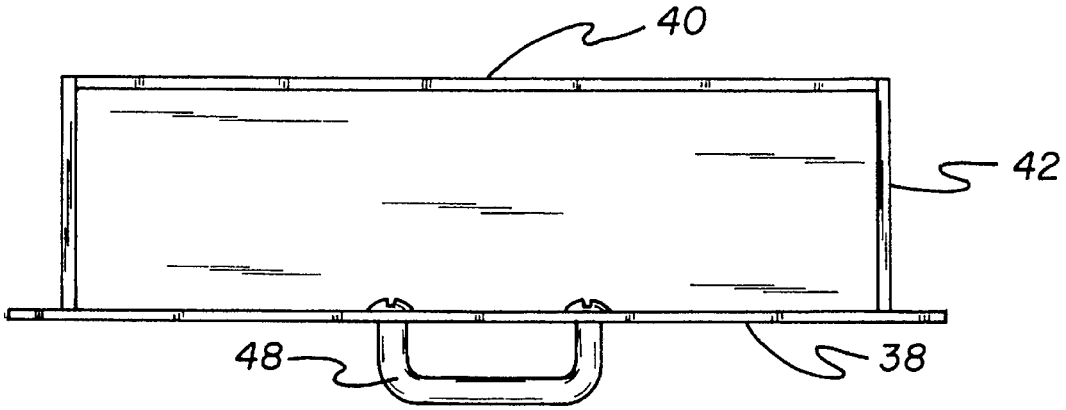
FIG. 5 is a cross-sectional view as taken along line 5—5 of FIG. 4.
Figure 6:
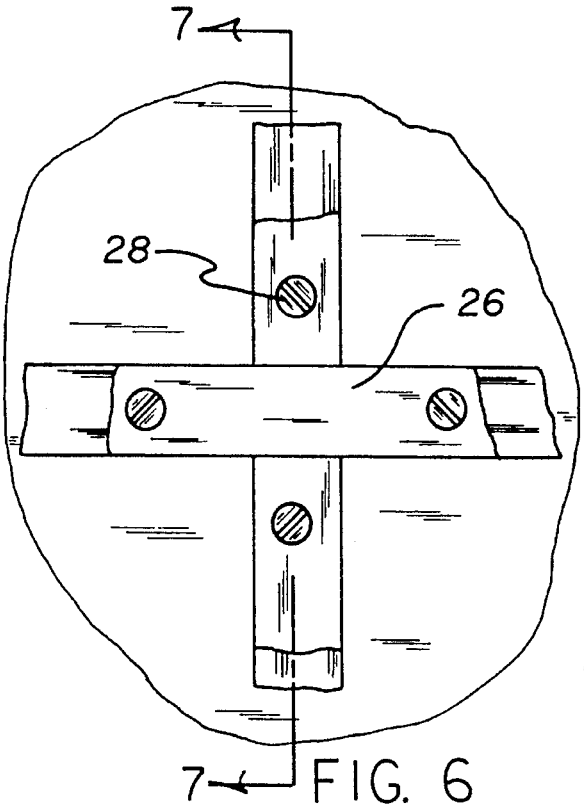
FIG. 6 is a front view of securement bracket of the present invention.
Figure 7:
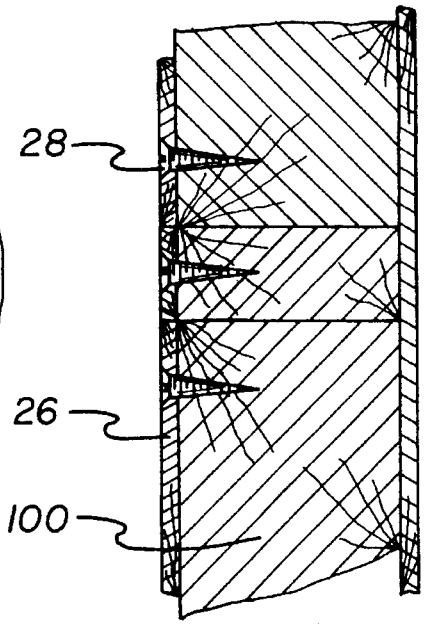
FIG. 7 is a cross-sectional view as taken along line 7—7 Of FIG. 6.

With reference now to the drawings, and in particular, to FIG. 1 thereof, the preferred embodiment of the new and improved wall mounted filing cabinet embodying the principles and concepts of the present invention and generally designated by the reference number 10 will be described.

Specifically, it will be noted in the various Figures that the device relates to a new and improved wall mounted filing cabinet for providing a place to store office documents but not requiring floor space. In its broadest context, the device consists of a cabinet and a plurality of bins. Such components are individually configured and correlated with respect to each other so as to attain the desired objective.

The first component of the device 10 is a cabinet 12. The cabinet 12 has a generally rectangular configuration. The cabinet 12 has a front surface 14, a rear surface 16, a top surface 18, a bottom surface 20, and two side surfaces 22. The front surface 14 has a plurality of rectangular shaped openings 24 formed therethrough. The rear surface 16 has a plurality of securement brackets 26 secured thereto. Each of the securement brackets 26 has screws 28 extending therethrough to secure the cabinet 12 to a wall 100. The preferred number of openings 24 is twelve, with three vertical rows each containing four openings 24. The size of the cabinet 12 and the number and size of the openings 24 can vary to accommodate the needs of a variety of user's. The cabinet 12 can be secured directly to the wall 100 or, alternatively, within a recess formed within the wall 100 to further reduce the amount of space that the device 10 will occupy.

The second and final component of the device 10 is a plurality of bins 32. The number of bins 32 corresponds to the number of rectangular shaped openings 24 formed in the cabinet 12. Each of the bins 32 is configured to be received within a corresponding rectangular shaped opening 24. Each of the bins 32 has an open top end 34, a closed bottom end 36, a front wall 38, a rear wall 40, and two side walls 42. A lower lip portion 44 is secured to a lower edge of the front wall 38 whereby the lower lip portion 44 holds the bin 32 against a lower edge of the corresponding rectangular shaped opening 24 of the cabinet 12. An upper lip portion 46 is secured to an upper edge of the rear wall 40 whereby the upper lip portion 46 contacts an interior upper edge of the cabinet 12 when the bin 32 is in an open configuration to prevent the bin 32 from falling out of the corresponding opening 24. The front wall 38 of each bin 32 has a U-shaped handle 48 secured thereto.

The present invention is a system of filing bins 32 that are built into a wall in a room with limited space to serve as a filing system or for any other storage purpose.

The cabinet 12 and bins 32 are fabricated from wood or plastic in rows and columns. The number of each should be carefully considered by the owner to ensure there will be sufficient storage capacity. Rectangularly shaped, the cabinet 12 has openings 24 in the face to accommodate the pull-out bins 32. Each opening 24 measures 14½ inches wide, by 10¼ inches high. These measurements ensure the bins 32, which are slightly smaller, will fit easily into it. The bins 32 are shaped similarly to a shallow drawer, but do not open like one. The lower edge of the front wall 38 has a lower lip 44 that fits into the cabinet 12 and holds this edge against the inside front panel. Similarly, an upper lip 46 is installed on the rear wall 40 to keep it from falling out when opened. The dimensions and finish of the design are very flexible, and should easily accommodate any interior design theme.

In use, the bins 32 are installed in each opening 24 and are then used as any ordinary filing cabinet would be. One extraordinary feature of this invention is that several bins 32 can be opened at one time without having to worry about the cabinet 12 falling forward—it is permanently secured in the wall 100.

It is a new filing cabinet design that not only provides a place to store the efforts of office production, but requires no floor space.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A wall mounted filing cabinet for providing a place to store office documents but not requiring floor space comprising, in combination:

a cabinet having a generally rectangular configuration, the cabinet having a front surface, a rear surface, a top surface, a bottom surface, and two side surfaces, the front surface having a plurality of rectangular shaped openings formed therethrough, the rear surface having a plurality of securement brackets secured thereto, each of the securement brackets having screws extending therethrough to secure the cabinet to a wall;

a plurality of bins, the plurality of bins corresponding to the plurality of rectangular shaped openings formed in the cabinet, each of the bins being configured to be received within a corresponding rectangular shaped opening, each of the bins having an open top end, a closed bottom end, a front wall, a rear wall, and two side walls, a lower lip portion secured to a lower edge of the front wall whereby the lower lip portion holds the bin against a lower edge of the corresponding rectangular shaped opening of the cabinet, an upper lip portion secured to an upper edge of the rear wall whereby the upper lip portion contacts an interior upper edge of the cabinet when the bin is in an open configuration below a horizontal plane to prevent the bin from falling out of the corresponding opening whereby contents of the bin can be viewed by a person with a line of sight below the horizontal plane, the front wall of each bin having a U-shaped handle secured thereto.

* * * * *